US007523826B2

(12) United States Patent
Thöing

(10) Patent No.: US 7,523,826 B2
(45) Date of Patent: Apr. 28, 2009

(54) AIRTIGHT SKIN PACK WITH HIGH WATER-VAPOR IMPERMEABILITY AND AROMA PROTECTION

(75) Inventor: Heinrich Thöing, Bad Neuenahr-Ahrweiler (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 504 days.

(21) Appl. No.: 10/503,529

(22) PCT Filed: Jan. 23, 2003

(86) PCT No.: PCT/EP03/00657

§ 371 (c)(1),
(2), (4) Date: Aug. 4, 2004

(87) PCT Pub. No.: WO03/066439

PCT Pub. Date: Aug. 14, 2003

(65) Prior Publication Data

US 2005/0145526 A1 Jul. 7, 2005

(30) Foreign Application Priority Data

Feb. 6, 2002 (DE) ..... 102 04 675

(51) Int. Cl.
*B65D 75/34* (2006.01)
*B65D 75/28* (2006.01)

(52) U.S. Cl. ..... 206/469; 206/484; 383/200

(58) Field of Classification Search ..... 206/461–471, 206/531, 534, 534.1, 538, 484, 484.1; 383/200
See application file for complete search history.

(56) References Cited

U.S. PATENT DOCUMENTS 2,750,719 A 6/1956 Wandelt
3,358,829 A 12/1967 Smith et al.
3,464,544 A * 9/1969 Jack ..... 206/468

(Continued)

FOREIGN PATENT DOCUMENTS

GB 752719 7/1956

(Continued)

OTHER PUBLICATIONS

M. Oscar Gregory Malavarca, Brevet D'Invention, 1996, P.V. 48,227, N 1466937.

*Primary Examiner*—Jila M Mohandesi
(74) *Attorney, Agent, or Firm*—Frommer Lawrence & Haug LLP

(57) ABSTRACT

The invention relates to a method for packaging piece-items in a disposable packaging, and to a disposable packaging. A labelled support card comprising at least one gas-impermeable layer is provided with at least one piece-item. The projected bearing surface of the piece-item and a joint surface of the labelled support card surrounding said bearing surface are smaller than the largest gas-impermeable layer. Openings are made around said joint surface along a closed three-dimensional curve, piercing at least all the gas-impermeable layers. The fitted support card is covered by a gas-impermeable extensible film. The space defined by the extensible film and the support card is evacuated by means of the openings. At least one joint surface of the extensible film enters into adhesive contact with at least one joint surface of the labelled support card, forming a sealed joint.

18 Claims, 5 Drawing Sheets

U.S. PATENT DOCUMENTS

| | | | | | |
|---|---|---|---|---|---|
| 3,481,101 | A | | 12/1969 | Steadman | |
| 3,523,863 | A | * | 8/1970 | Juhos | 428/195.1 |
| 4,589,568 | A | * | 5/1986 | Ito et al. | 220/359.3 |
| 5,178,293 | A | * | 1/1993 | Suzuki et al. | 220/359.3 |
| 5,775,505 | A | * | 7/1998 | Vasquez et al. | 206/538 |
| 5,833,071 | A | * | 11/1998 | Ray | 206/532 |

FOREIGN PATENT DOCUMENTS

| | | |
|---|---|---|
| JP | 38026350 | 5/1962 |
| JP | 60013612 | 1/1985 |
| WO | WO 93/24374 | 12/1993 |
| WO | WO 00/78611 A2 | 12/2000 |

* cited by examiner

AIRTIGHT SKIN PACK WITH HIGH WATER-VAPOR IMPERMEABILITY AND AROMA PROTECTION

The invention relates to a method for packing piece items in a disposable pack and also to a disposable pack.

For the packing of piece items in disposable packs, use is often made of support cards or so-called skin cards, which after being provided with the item are covered with a film of plastic. Covering with the film usually takes place by stretch-molding a firmly clamped extensible film. When it is being used for covering the piece item on the support card, the extensible film, which has for example been preheated, is made to extend, changing the wall thickness. At the same time, the intermediate space between the extensible film and the support card is evacuated through the air-permeable support card, so that the extensible film comes to lie snugly against the piece item and against the support card, cf. inter alia WO 93/24374 A1. The extensible film and the support card, which has for example been coated with a heat-sealing layer, respectively contact each other with a joining surface. On account of the air permeability of the support card, moisture or aromatic substances can escape and make the piece item dry out or become unusable. Equally well, moisture can penetrate into the disposable pack and in this way damage the packed product.

In FR 1,466,937, a pack and a method for producing this pack are described. During the production, a film is adhesively attached to a porous support card, this lower film being perforated over its entire surface area before and after the adhesive attachment. After the support card prepared in this way has been provided with the item, a further film is drawn over the item to be packed and the support card while being heated. This upper film is then sucked through the support card onto the packed item and the perforated lower film. Because of the perforation of the lower film and of the support card, the pack is gas-permeable, and consequently not aromatight, in all regions in which the upper film is not resting on the lower film—that is at least in the zone in which the item is lying.

Furthermore, in WO 00/78611 A2 a description is given of a method for producing a pack in which an air-impermeable lower film is adhesively attached to a support material and a further upper film is drawn over the item to be packed while being heated. The air between the two films is sucked away at the edges of the lower film through channels let into the support material. To improve the adhesion in the joining surface, it has beads into which the films are drawn. External influences, such as temperature or moisture for example, can have the effect that the adhesive bond between the films is broken and moisture can penetrate into the enclosed space.

The present invention is therefore based on the problem of developing a packing method for a disposable pack and of developing a disposable pack which offers good aroma and moisture protection of the piece item.

This problem is solved by the features of the main claim. For this purpose, a labeled support card, which comprises at least one gas-impermeable layer, is provided with at least one piece item. In this case, the projected bearing surface of the piece item on the labeled support card and a joining surface of the labeled support card surrounding said bearing surface are smaller than the largest gas-impermeable layer. Openings which pierce at least all the gas-impermeable layers are produced around the joining surface along a closed three-dimensional curve. The support card provided with the item is covered with a gas-impermeable extensible film. The intermediate space delimited by the extensible film and the support card is evacuated through the openings. At least one joining surface of the extensible film enters into firm adhesive contact with the joining surface of the labeled support card, forming a sealed joint.

During the evacuation of the intermediate space between the extensible film and the support card, the extensible film comes to lie against the label. The air is sucked away from the joining surface through the openings. The extensible film is sucked snugly onto the joining surface of the labeled support card and firmly adheres to it. As a result, a sealed joint, surrounding the piece item, forms with the label support card. During this joining, the joining surfaces of the extensible film and of the label are sealed to each other. This uniform sealing around the piece item prevents the exchange of moisture or of aromatic substances of the piece item with the surroundings. The pack is airtight.

The openings, unevennesses of the labeled support card, may be combined possibly with hollows or depressions or elevations of the label. In this case, the openings pierce at least all the gas-impermeable layers of the labeled support card. They may surround the bearing surface at regular or irregular intervals. The unevennesses lie in this case on a planar or three-dimensionally tortuous, possibly discontinuous, series of curves.

The bearing surface may also be surrounded by a continuous or endless bead or elevation. The openings may be arranged as a perforation—with for example equidistant impressions.

The piece items may be, for example, pharmaceutical products or dosing dispensers in which pharmaceutical products are kept. The pharmaceutical products are often particularly sensitive to moisture, loss of aroma and loss of active ingredients. The sealing of the joining surfaces in the zone of the unevennesses prevents premature aging or damage to the products and increases their shelf life.

The covering of the support card with the film may take place in a stretch-molding process, for example in a skin process. In this case, for example, the extensible film is placed onto the piece item while undergoing thermoforming. The individual piece items are then packed in a skin pack.

The label may comprise, for example, a piece of paperboard or a film that has been printed on, for the presentation of the product. It may be of a single-layer or multi-layer construction. In this case, the side of the label that is facing the piece item may, for example, have a moisture- and aromatight film. For example in order to ensure good readability of the label, this film may be a clear, non-polar or low-polarized film. In order to permit adhesion of the extensible film to such a film, an adhesive, for example an adhesive sealing layer, is applied for example to this film. However, the use of a polarized film is also conceivable.

The extensible film is, for example, a clear, non-polar or low-polarized film.

Further details of the invention emerge from the subclaims and the description which follows of schematically represented embodiments.

Figure 4:
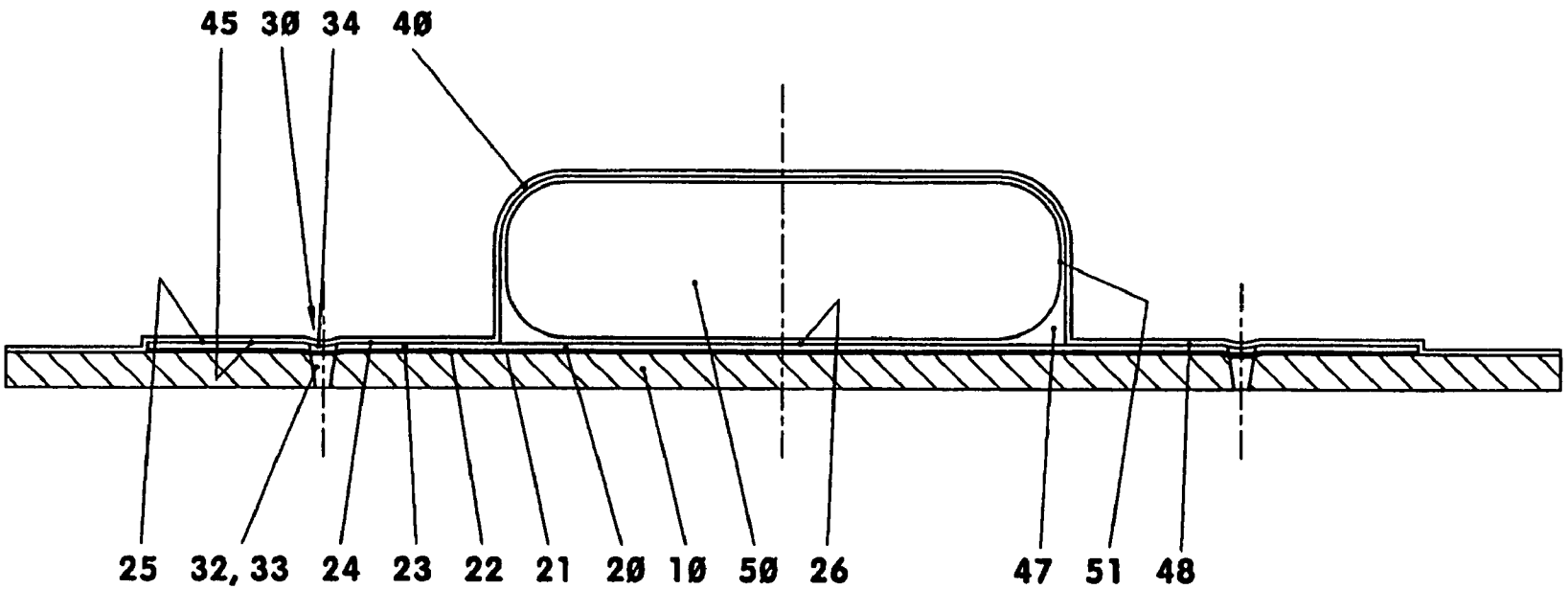
FIG. 4 shows a disposable pack of piece items.
Figure 5:
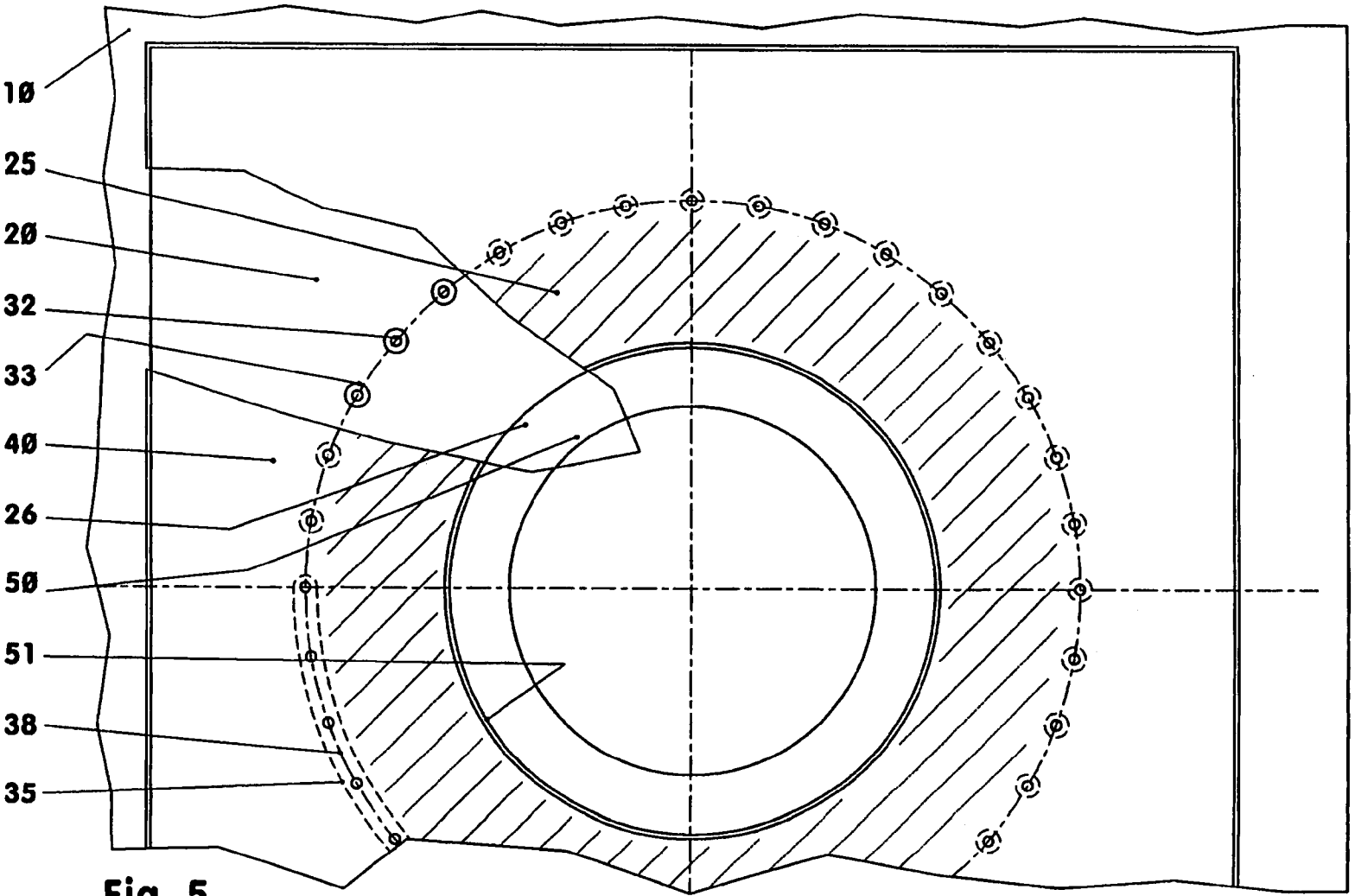

FIG. 5: shows a partial plan view of FIG. 4.

Figure 1:
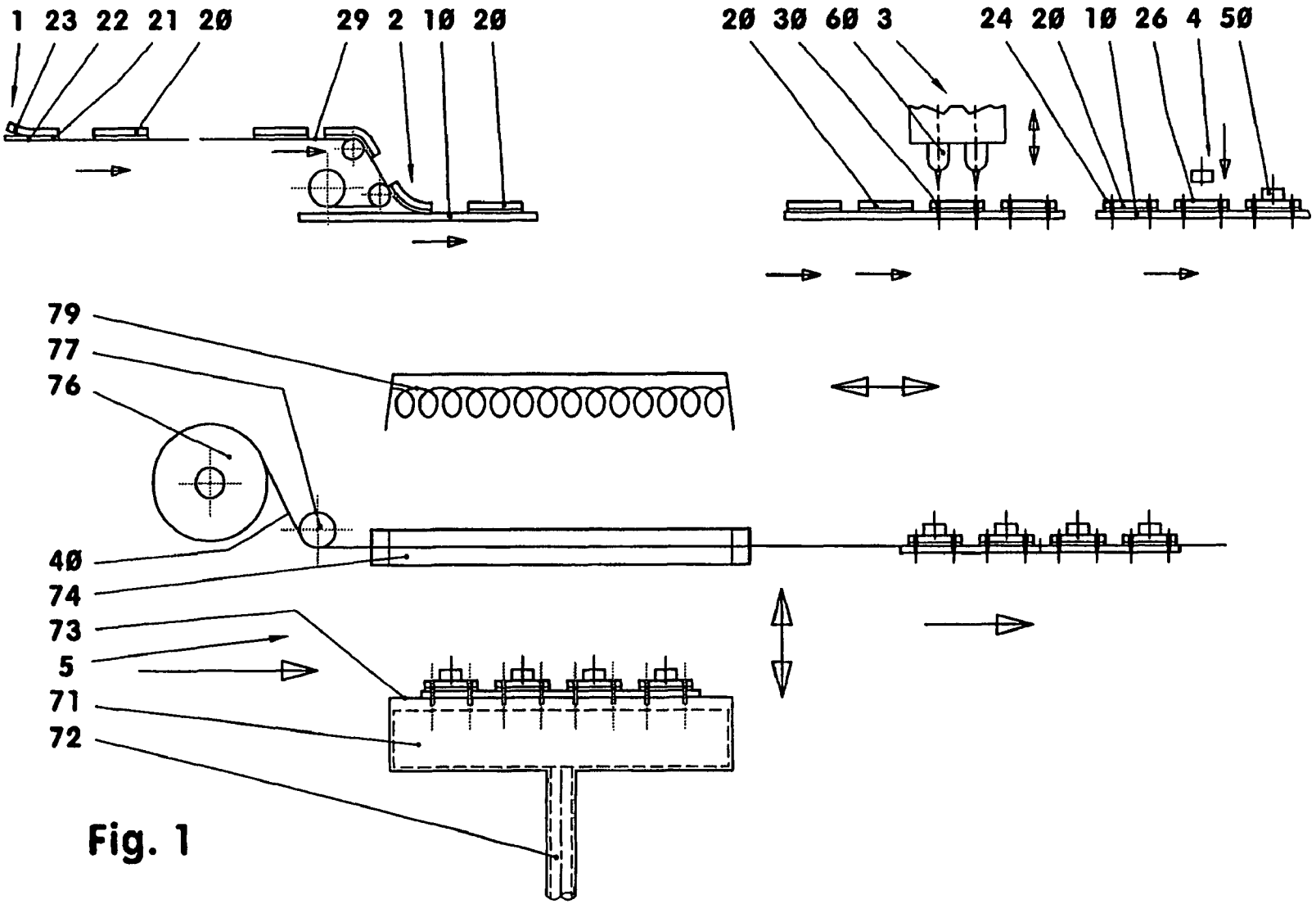
FIG. 1 shows method steps for packing piece items.

FIG. 1 shows method steps for packing piece items in disposable packs. In a first step (1), a label (20) is produced, and, in a second step (2), it is applied to a support card (10), for example a skin card. After the labeling, for example, in a third step, the label (20) with the support card (10) is perforated, before, in a fourth step (4), the individual support card (10) is provided with a piece item (50), for example a dispenser pack (50). In a fifth step (5), the support card (10) provided with the item is then covered with an extensible film (40).

The label (20)—represented here with exaggerated height—is constructed for example with two layers. For producing the label (20), a one-sided self-adhesive film of plastic (21) is applied for example to a support tape (29), the adhesive side (22) facing the support tape (29). The film of plastic (21) has, for example, a thickness of 30 μm. A gastight film (23) of non-polar plastic, for example a polyethylene film with a thickness of 100 μm, is then applied, for example by means of solvent lamination, to this film of plastic. Said gastight film bears on its side facing away from the film of plastic (21), for example, an adhesive sealing layer (24), which has been produced for example by brushing with a heat-sealing adhesive.

The label (20) produced in this way is conveyed, for example by means of the support tape (29), to labeling (2). Here, the label (20) is removed from the support tape (29) and applied to the, for example, gas-permeable support card (10). The label (20) then adheres with the self-adhesive side (22) of the film of plastic (21) on the support card (10). The labeling (2) may take place statically or dynamically, i.e. with the support card (10) stationary or moving. If the label (20) is round and does not bear any text, it may be aligned in any direction on the support card (10); if it is of a different form; it has one or more preferred directions.

Figure 2:
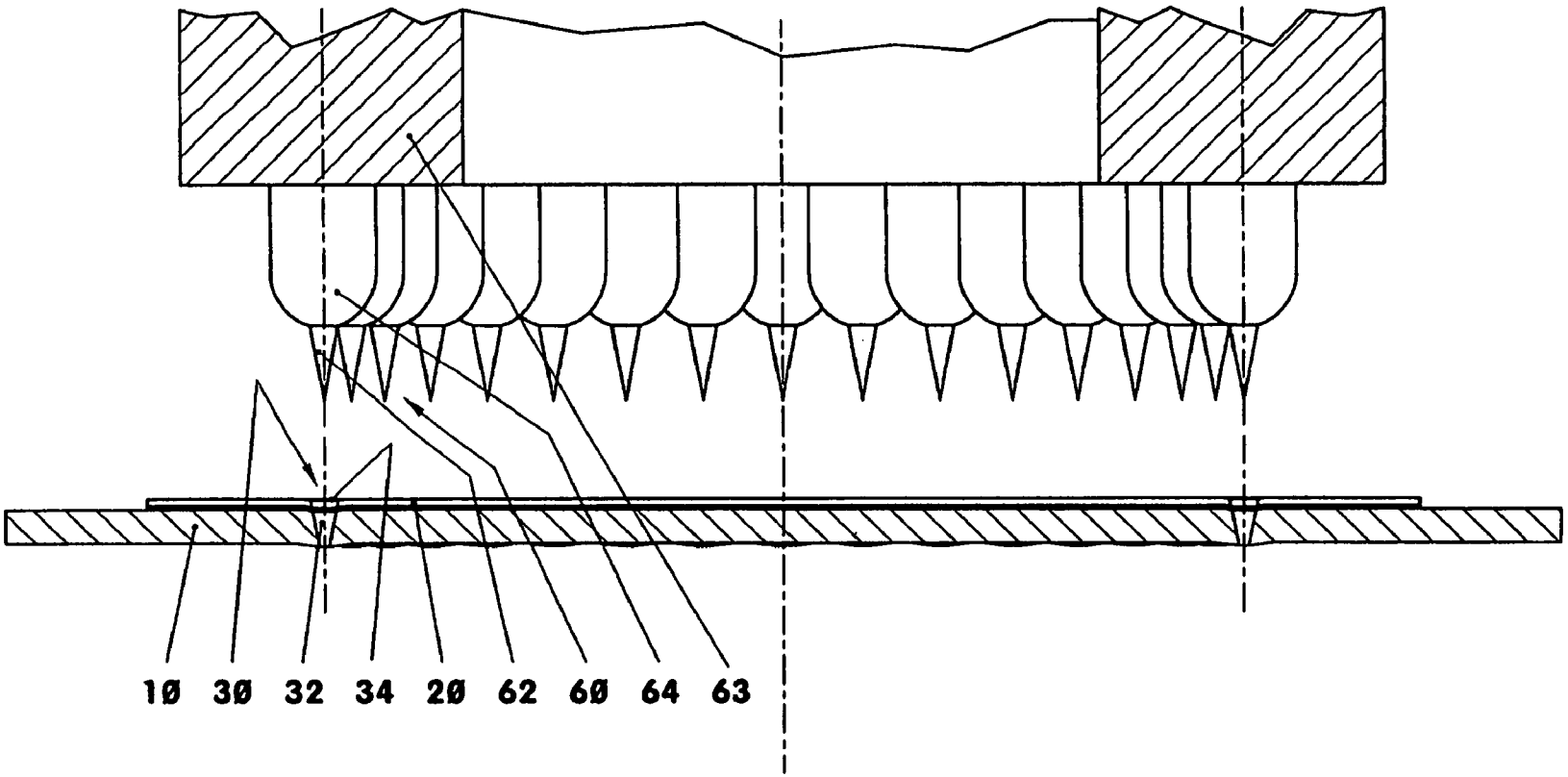
FIG. 2 shows a detail of the piercing needling.

In the next method step (3), the labels (20) with the cards (10) are perforated in a predetermined zone, outside the later bearing surface (26) of the piece item (50). During the perforation, openings (32) are produced at regular intervals on a closed three-dimensional curve (38) surrounding the later bearing surface (26), cf. FIG. 5. In this case, the distance of the three-dimensional curve (38) from the bearing surface (26) is, for example, at least 2 mm, possibly approximately 3 mm. FIG. 2 shows this step enlarged. The tools (60) for this are, for example, 36 severing tools in the form of individual needles (62), which are driven for example by means of a common lifting, pivoting and/or transporting mechanism (63). These needles (62) have, for example, a diameter of 1.5 mm and a point angle of 22°. The length of the point is consequently approximately 4 mm. These needles produce in the label (20) and in the support card (10) many openings (32), which for example taper from top to bottom. The individual tool (60) respectively comprise, for example, a forming tool arranged around each individual needle (62), for example individual bosses (64) with a diameter of 15 mm. During the needle stroke, shortly before reaching the lower end position, the bosses (64) come into engagement with the label (20). They cause the latter to sink in for example by about 0.4 mm. The openings (32) and the boss impressions (34) constitute unevennesses (30) of the surface of the label (20).

The openings (32) may also be formed cylindrically or with some other geometrical form. Instead of with a needle (62), the openings (32) or sunk impressions may also be produced with some other forming and/or severing tool (60). The individual severing tool (62) may, for example, also be a cutter with which openings (32) are produced. Instead of a perforation (33), individual discrete openings (32), possibly with sunk impressions, may also be created.

The unevennesses (30) of the label (20) produced by a forming tool (64) may, for example, be concave or convex. The forming tool (64) can form the surface of the label (20) freely or for example with a die. The unevenness (30) may be, for example, a channel-like bead (35) which runs along the three-dimensional curve (38) and forms a tangent to or intersects the openings (32), cf. FIG. 5, third quadrant.

When the support card (10) is provided with an item, cf. FIG. 1, an individual dispenser pack (50) is for example placed onto a label (20). The dispenser pack (50) then lies for example flat on the bearing surface (26), within the perforation (33).

In the next processing step (5), the support card (10) provided with an item in this way is placed onto a lifting table (71). This lifting table (71) has in its table surface (73) for example suction channels, which are connected to an evacuation connection (72). After it is placed on, the support card (10) may cover over some of the suction channels.

Arranged above the lifting table (71) is a clamping frame (74), which clamps the extensible film (40), which is made available, for example unwound from a drum (76). The extensible film (40) is, for example, a non-polar or weakly polarized polyethylene film with a thickness of 80 μm and an elongation at break of about 300%. The surface area of a clamping frame (74) extended over by the extensible film (40) is, for example, larger here than the table surface (73) of the lifting table (71). Arranged on the inwardly directed surfaces of the clamping frame (74) are, for example, sealing elements that are not represented here.

Arranged above the clamping frame (74) is a heater (79). This can, for example, be pivoted away to the side.

For covering the support card (10) with the extensible film (40), the lifting table (71) is raised until the clamping frame (74) encloses the lifting table (71) in a gastight manner. Then, an evacuation pump connected to the evacuation connection (72) is switched on. The ambient pressure continues to prevail on the side of the extensible film (40) that is oriented toward the heater (79), while the pressure is reduced in the intermediate space (47) delimited by the extensible film (40) and the support card (10).

In this case, the extensible film (40) comes to lie against the dispenser pack (50) and against the label (20).

The air is sucked away from the intermediate space (47) between the support card (10) and the extensible film (40), cf. FIG. 4, through the gas-permeable support card (10) and through the openings (32). In this case, the boss impressions (34) act for example as inlet channels for the air. Some of the air of the intermediate space (47) can also be sucked away around the support card (10). The intermediate space (47) is reduced in size to a residual space, cf. FIG. 4. The extensible film (40) comes to lie against the edge (51) of the dispenser pack (50) and against the label (20). In this case, a joining surface (45) of the extensible film (40) enters into contact with the gas-permeable layer (23) of the label (20), coated with the adhesive sealing layer (24), inter alia in a joining surface (25). This joining surface (25) of the label (20) is delimited inwardly by the bearing surface (26) of the piece item (50) and outwardly by the three-dimensional curve (38). When it is placed on, the extensible film (40) overhangs the joining surface (45) at least outwardly.

By means of the heater (79), the extensible film (40) is heated up, for example to about 80° C. In this temperature range, the extensible film (40) has, for example, viscous properties and, when the lifting table (71) is raised, extends over the dispenser pack (50), while its wall thickness is reduced. When the lifting table (71) is raised further and more of the air is sucked away, the extensible film (40) comes to lie snugly against all the free surfaces of the dispenser pack (50) and against the label (20). Under the effect of the heater, the hot sealing adhesive makes it possible for the extensible film (40) to be joined with the label (20). The evacuation by suction has the effect that the extensible film (40) is drawn over its full surface area onto the joining surface (25) of the label (20) and adheres to the latter. The part of the extensible film (40) overhanging the joining surface (25) of the label (20) likewise comes to lie against the label (20). Consequently, the extensible film (40) covers over the unevennesses (30), the perforation (33), the openings (32) and/or the bosses (34). The two joining surfaces (25, 45), adhering one on top of the other, form a sealed joint (48) and in this way seal the dispenser pack (50) against moisture or loss of aroma. After switching off or pivoting away the heater (79), the extensible film (40) sets in the form it has then assumed on the support card (10).

In a further processing step not represented here, the support card (10), provided with an item and coated, is divided into individual packaging units, each containing at least one dispenser pack (50).

FIGS. 4 and 5 show a dispenser pack (50) packaged in this way, in section and in a partial plan view. The two-layer label (20) has been applied to the support card (10). Outside the bearing surface (26) of the dispenser pack (50) projected onto the support card (10), the perforation (33) is arranged for example on a circular three-dimensional curve (38). The extensible film (40) lies snugly against the dispenser pack (50) and with the joining surface (45) against the label (20). In this case, the extensible film (40) enters into contact on both sides of the perforation (33) with the label (20). The extensible film (40) has been drawn into the individual openings (32) of the perforation (33), sunken by boss impressions (34). Between the three-dimensional curve (38) and the edge (51) of the dispenser pack (50) is the sealed joining surface (25), closed here in the form of a ring. It is represented as shaded in FIG. 5.

For opening the packaging units, pressure is exerted on the extensible film (40) from above, for example in the region of the dispenser pack (50), while the support card (10) is held in restraint at its edges. The support card (10) tears open at the perforation (33) and, according to FIG. 4, permits downwardly directed removal of the dispenser pack (50).

The label (20) may also be of a single-layer construction. It may comprise an adhesive layer, for example, on the side facing away from the card (10). A multi-layer label (20) may, for example, also be produced on the support card (10).

The gas-impermeable layer (23) may be part of the label (20) and/or of the support card (10). For example, a gas-impermeable support card (10) may be combined with a gas-permeable or gas-impermeable label (20).

For example in the case of a gas-permeable support card (10), the openings (32) may pierce only the label (20) or a gastight layer (23) of the label (20) enclosing the joining surface (25). During the further processing and later sale, no openings are then visible on the support card (10).

Figure 3:
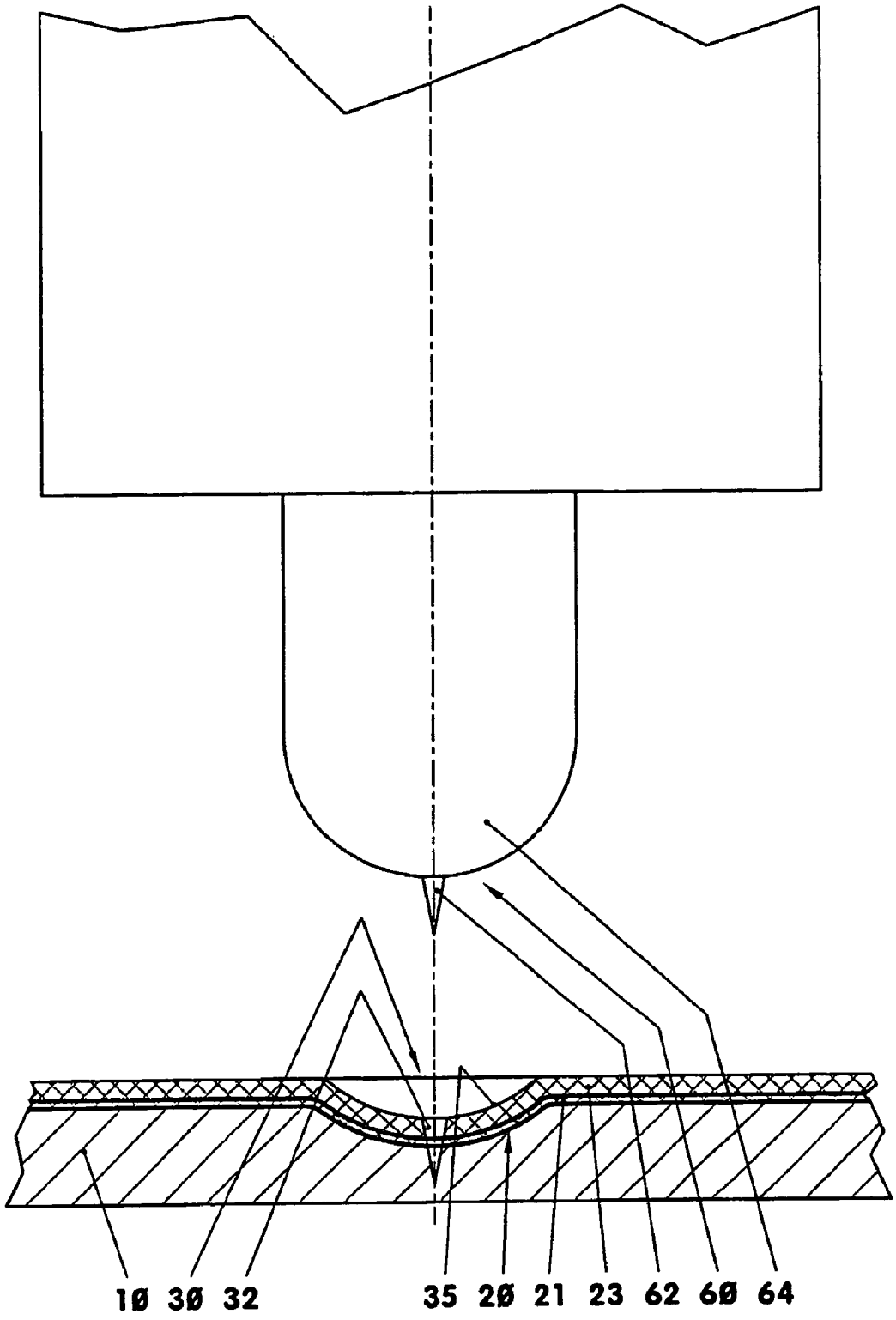
FIG. 3 shows a detail of the non-piercing needling.

FIG. 3 shows openings (32) arranged in this way. They penetrate the gas-impermeable layer (23), facing the dispenser pack (50), of the label (20). In this case, the incision produced by the needle tip protrudes for example into the support card (10). The openings (32) are arranged for example in a peripheral bead (35), which is produced with a forming tool (64) against a die as a restraining holder.

As a result, the support card (10) retains its planar underside. During the return stroke of the forming tool (64), frayed fringes possibly produced with the needle (62) remain in the space of the bead (35) and consequently do not hinder the subsequent coating and joining.

The sequence of the method steps may be different. For example, the third method step (3) here, the perforation and possibly bossing, may take place before or after the provision of an item (4). Bossing may also take place during the covering of the support card (10) with the extensible film (40). In this case, the extensible film (40) may also be deformed together with the label (20).

LIST OF DESIGNATIONS

1 first method step
2 second method step
3 third method step
4 fourth method step
5 fifth method step
10 support card
20 label
21 single-sided adhesive film of plastic
22 adhesive side
23 gastight film, polyethylene film, gas-impermeable film
24 adhesive sealing layer
25 joining surface
26 bearing surface
29 support tape
30 unevennesses
32 openings
33 perforation
34 boss impressions
35 bead
38 three-dimensional curve
40 extensible film, gastight film
45 joining surface
47 intermediate space, residual space
48 sealing surface, sealing; sealing zone; joint
50 piece item, dispenser pack
51 edge of the piece item
60 forming and/or severing tools
62 needles, severing tool
63 lifting, pivoting and/or transporting mechanism
64 bosses, forming tool
71 lifting table
72 evacuation connection, suction connection
73 table surface
74 clamping frame
76 drum
77 tensioning roller
79 heater

The invention claimed is:

1. A disposable pack of piece items, which comprises a support card labeled with a label wherein the label has a joining surface and comprises of at least one gas-impermeable layer and a gas-impermeable extensible film;

wherein the gas-impermeable extensible film has a joining surface and lies against a piece item and the labeled support card;

a bearing surface projected onto the labeled support card and the joining surface of the label surrounding said bearing surface being smaller than the largest gas-permeable layer;

an opening which pierce at least all the gas-impermeable layers being arranged around the joining surface along a closed three dimensional curve, wherein the opening contains boss impressions; and wherein at least one joining surface of the extensible film entering into firm adhesive contact with the joining surface of the labeled support card, forming a sealed joint.

2. The disposable pack as claimed in claim 1, which further comprises a label which comprises a single-sided self-adhesive film of plastic, wherein the self-adhesive side of said self-adhesive film faces the support card.

3. The disposable pack as claimed in claim 2, wherein the label further comprises a gas-impermeable layer which is laminated at least approximately over the entire surface area on the side of the self-adhesive film of plastic which faces away from the support card.

4. The disposable pack as claimed in claim 2, wherein the side of the label that is facing away from the support card is provided with an adhesive sealing layer.

5. The disposable pack as claimed in claim 3, characterized in that the gas-impermeable layer and gas-impermeable extensible film are non-polar polyethylene films.

6. The disposable pack as claimed in claim 1, wherein the extensible film has an elongation at break of about 300%.

7. A disposable pack containing piece items, which comprises:

a gas-permeable support card a label which comprises of:

(i) a one-sided self-adhesive film of plastic wherein the adhesive part of the film of plastic contacts the top of the gas-permeable support card; and (ii)a gastight film of non-polar plastic which on one side contacts the non-adhesive side of the film of plastic and on the other side contains an adhesive sealing layer;

a piece item which on one side contacts the adhesive sealing layer on the label, wherein the contact area between the piece item and the label is the bearing surface, and is contacted on all other sides by a gas-impermeable extensible film, wherein the gas-impermeable extensible film also contacts the label;

wherein the gas-permeable support card contains openings in the label and the gas-permeable support card in the area outside the bearing surface and the openings contain boss impressions.

8. A method for packing piece items in the disposable pack of claim 7, a labeled support card, which comprises at least one gas-impermeable layer, being provided with at least one piece item, the projected bearing surface of the piece item on the labeled support card and a joining surface of the labeled support card surrounding said bearing surface being smaller than the largest gas-impermeable layer, openings which pierce at least all the gas-impermeable layers being produced around the joining surface along a closed three-dimensional curve, the support card provided with the item being covered with a gas-impermeable extensible film, the intermediate space delimited by the extensible film and the support card being evacuated through the openings, and at least one joining surface of the extensible film entering into firm adhesive contact with the joining surface of the labeled support card, forming a sealed joint.

9. The method as claimed in claim 8, characterized in that the gas-impermeable layer of the labeled support card is the layer facing the piece item.

10. The method as claimed in claim 8, characterized in that the openings produced penetrate the label and the support card.

11. The method as claimed in claim 8, characterized in that unevennesses of the label are produced in the region of the three-dimensional curve by means of forming tools.

12. The method as claimed in claim 8, characterized in that, before the joining, the label is provided with an adhesive sealing layer.

13. The method as claimed in claim 8, characterized in that the extensible film is a polyethylene film.

14. The method as claimed in claim 10, characterized in that the openings are produced in the form of a perforation.

15. The method as claimed in claim 10, characterized in that the openings are conically formed, the individual opening having the greater diameter on the side of the label.

16. The method as claimed in claim 10, characterized in that the openings are sunken as impressions.

17. The disposable pack as claimed in claim 7, characterized in that the gastight film and gas-impermeable extensible film are non-polar polyethylene films.

18. The disposable pack as claimed in claim 17, wherein the extensible film has an elongation at break of about 300%.

* * * * *